US005881736A

United States Patent [19]

Turner et al.

[11] Patent Number: 5,881,736

[45] Date of Patent: Mar. 16, 1999

[54] APPARATUS AND METHOD FOR DECORATING HAIR

[76] Inventors: Pamela J. Turner; Walter F. Turner, both of 47 Bartlett St., Leominster, Mass. 01453

[21] Appl. No.: 797,839

[22] Filed: Feb. 10, 1997

[51] Int. Cl.[6] ..... A45D 24/00

[52] U.S. Cl. ..... 132/200; D28/41; 132/275

[58] Field of Search ..... 132/200, 201, 132/210, 222, 246, 247, 248, 270, 274, 275, 273; D28/39, 41

[56] References Cited

U.S. PATENT DOCUMENTS

| | | | |
|---|---|---|---|
| D. 353,226 | 12/1994 | Nahoum | D28/41 |
| 1,612,911 | 1/1927 | Durnerin | 132/246 |
| 1,654,775 | 1/1928 | Bailey | 132/222 |
| 1,734,961 | 11/1929 | Brown | 132/222 |
| 1,872,549 | 8/1932 | Allen | 132/222 |
| 1,981,362 | 11/1934 | Joyce | 132/222 |
| 2,061,356 | 11/1936 | Gosewisch | 132/248 |
| 2,655,924 | 10/1953 | Patitta | 132/200 |
| 3,543,770 | 12/1970 | Snider | 132/270 |
| 3,610,257 | 10/1971 | Hall | 132/270 |
| 3,889,692 | 6/1975 | Redrow | 132/210 |
| 5,154,196 | 10/1992 | Moffat . | |
| 5,388,598 | 2/1995 | Whitten . | |
| 5,404,892 | 4/1995 | Bretl . | |
| 5,411,040 | 5/1995 | Forrest | 132/210 |
| 5,458,108 | 10/1995 | Jacobs | 132/273 |
| 5,465,741 | 11/1995 | Dvorak . | |
| 5,472,003 | 12/1995 | Frame et al. | 132/275 |
| 5,497,795 | 3/1996 | Hibbard . | |

*Primary Examiner*—Jeffrey A. Smith
*Assistant Examiner*—Eduardo C. Robert
*Attorney, Agent, or Firm*—Blodgett & Blodgett, P.C.

[57] ABSTRACT

A device for producing a "hair wrap". The device includes an elongated open ended tube which has a layer of decorative material on the outside of the tube and an elongated filament loosely positioned within the tube and extending from both ends of the tube. One extending end of the filament has a loop. The device is used by extending a strand of hair through the loop at a first end of the tube and pulling the filament from the opposite end of the tube so that the loop and strand of hair are drawn into the tube. The tube or decorative material at the first end of the tube is secured to the strand of hair near the scalp and the filament is withdrawn from the tube. More specifically, the layer of decorative material are formed by winding a pair of strands of decorative material such as string or yarn about the tube so that an end of each strand of decorative material extends beyond the first end of the tube. The freely extending ends of the strand are used to secure the device to the strand of hair. Beads or other decorative items are applied to the tube during the wrapping of the strands of decorative material about the tube.

9 Claims, 6 Drawing Sheets

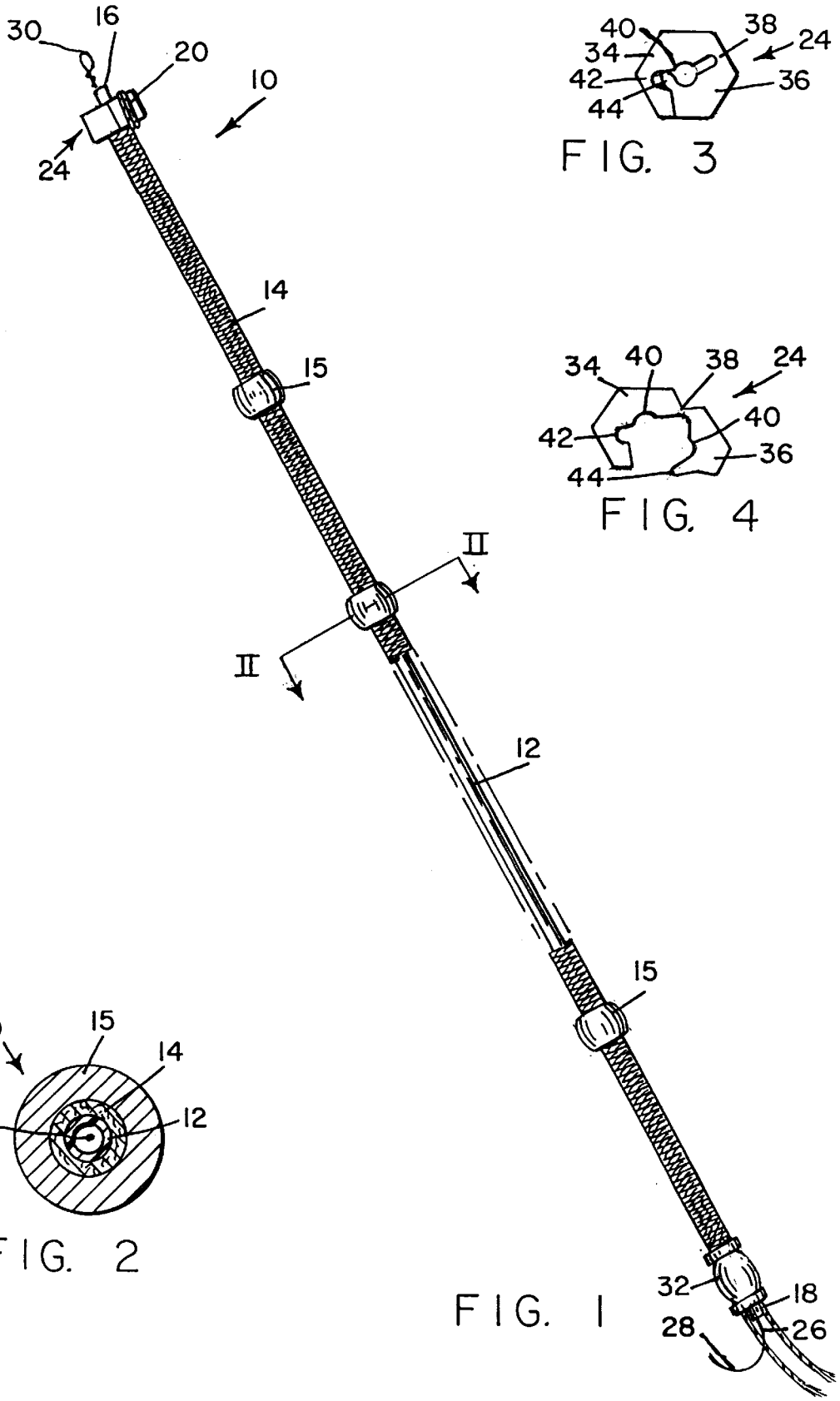
FIG. 1
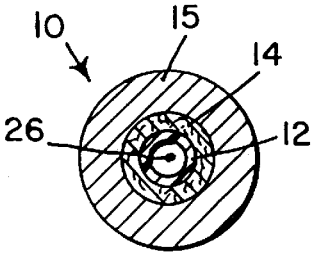
FIG. 2
FIG. 3
FIG. 4

APPARATUS AND METHOD FOR DECORATING HAIR

CROSS-REFERENCE TO RELATED APPLICATIONS

Not applicable

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed generally to a method of decorating hair and apparatus for performing the method. The invention is directed particularly to the simulation of a form of hair decoration which is known as a "hair wrap".

A conventional "hair wrap" procedure involves wrapping a strand of string, yarn, or other flexible material about a strand of hair while intermittently applying beads or other decorative items as the string is applied to the strand of hair. This procedure is very tedious and time consuming and, consequently, very costly.

It is, therefore, a principal object of the present invention to provide an apparatus and procedure for producing a "hair wrap" decoration in a person's hair without wrapping the decoration on the person's hair.

A further object of the present invention is the provision of an apparatus producing a "hair wrap" decoration in a person's hair which is simple in construction and easy to use.

Another object of the invention is the provision of a method of producing a "hair wrap" decoration in a person's hair which takes substantially less time to produce than conventional "hair wrap" methods.

BRIEF SUMMARY OF THE INVENTION

The invention consists of a device for producing a "hair wrap". The device includes an elongated open ended tube which has a layer of decorative material on the outside of the tube and an elongated filament within the tube. The filament extends from both ends of the tube. One extending end of the filament has a loop. The device of the present invention is used by extending a strand of hair through the loop at a first end of the tube and pulling the filament from the opposite of the tube so that the loop and strand of hair are drawn into the tube. The tube or the decorative material at the first end of the tube is secured to the strand of hair near the scalp and the filament is withdrawn from the tube. More specifically, the layer of decorative material is formed by winding a pair of strands of decorative material such as string or yarn about the tube. An end of each strand of decorative material is secured to a releasable clasp. The strand of hair is clamped within the first end of the tube by the clasp for securing the tube to the strand of hair . It is also possible to extend the free ends of the strands beyond the first end of the tube. The freely extending ends of the strand are used to secure the device to the strand of hair. Beads or other decorative items are applied to the tube during the wrapping of the strands of decorative material about the tube.

BRIEF DESCRIPTION OF THE DRAWINGS

The character of the invention, however, may be best understood by reference to one of its structural forms, as illustrated by the accompanying drawings, in which:

FIG. 1 is a side elevational view of a hair decoration device embodying the principles of the present invention.

FIG. 2 is a cross-sectional view of the hair decoration device taken along the line of II—II of FIG. 1 and looking in the direction of the arrows;

FIG. 3 is a top plan view of a clasp which forms part of the hair decoration device showing the clasp in the closed position;

FIG. 4 is a top plan view of the clasp showing the clasp in the open position;

DETAILED DESCRIPTION OF THE INVENTION

Figure 5:
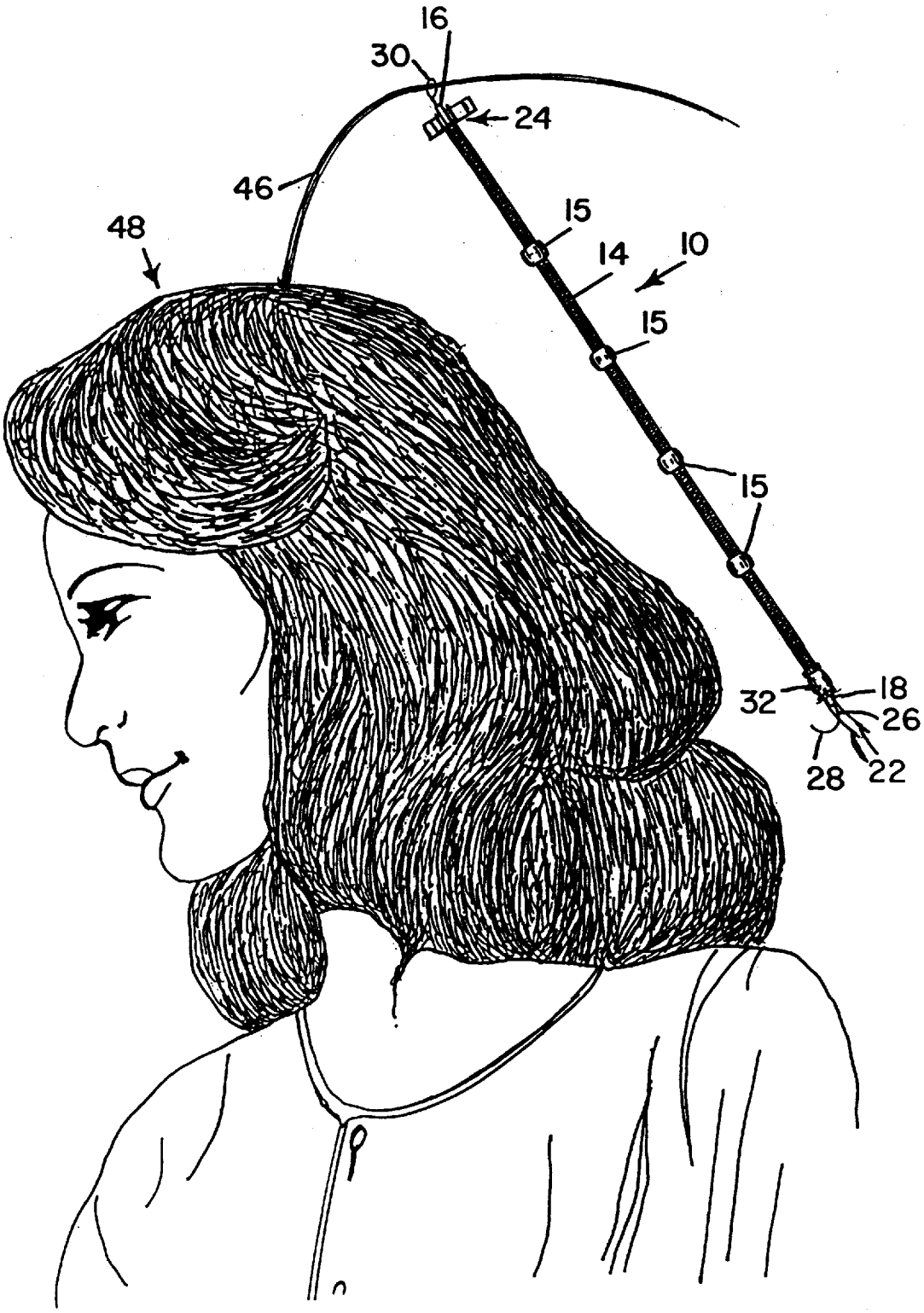
FIGS. 5–8 are operational views showing the decoration device of FIG. 1 being applied to the hair of a person.

Referring first to FIGS. 1–4, a hair decoration device, embodying the principles of the present invention, is generally indicated by the reference numeral 10. The device 10 comprises a flexible plastic tube 12, and a decorative layer 14 on the outside of the tube 12. The decorative layer 14 may also include other decorative items, such as beads 15. The tube 12 has a first open end 16 and a second open end 18. In the preferred embodiment, the decorative layer 14 is formed from a pair of strands of textile material such as threads or yarn. The strands have a pair of freely extending ends 20 which are tied to a releasable clasp 24. The opposite free ends of the strands of textile material are tied to the second end of the tube 12 and extend through a decorative bead 32 and beyond the second end 18 of the tube 12 for decorative purposes. An elongated filament extends along the inside of the tube 12. In the preferred embodiment of the present invention, the filament is a metal wire 26. The first end of the wire 26 is formed into a loop 30 which extends beyond the first open end 16 of the tube 12. A freely extending second end of the wire 26 extends beyond the second open end 18 of the tube 12.

Referring particularly to FIGS. 3 and 4, the clasp 24 has a generally hexagonal shape, and comprises two half portions 34 and 36 which are hinged at 38. Hinge 38 is integral with both halves 34 and 36 and constitutes a so called "living hinge". The half portion 34 has a recess 42. The half portion 36 has a projection 44. When the clasp 24 is moved from its open position, as shown in FIG. 4, to its closed position, as shown in FIG. 3, the projection 44 enters the recess 42 in a snap fit which maintains the two halves 34 and 36 in the closed position. When the half portions 34 and 36 are combined, as shown in FIG. 3, they define a central circular opening 40. The diameter of the opening 40 is substantially less than that of the outer diameter of the tube 12.

The hair decoration device 10 is formed by winding a pair of strands of textile material, such as string, yarn, or any other flexible material around the outside of the plastic tube 12 to form the decorative layer 14. Other decorative items such as the beads 15 are also applied to the tube 12 as the strands are wound around the tube. The free ends 22 of the decorative strands extend beyond the second end 18 of the tube for decorative purposes. The opposite free ends 20 of the strands are tied to the clasp 24. The wire 26 is extended through the tube 12 so that the second end 28 of the wire extends beyond the second open end 18 of the tube and the loop 30 extends beyond the first open end 16 of the tube. The loop 30 may be formed prior to or after insertion of the wire 26 into the tube 12. The loop 30 is small enough to enable the wire to be drawn through the tube from first open end 16 of the tube 12. The flexibility of the tube 12 and the wire 26 also enables a loop 30 which is slightly larger than the inner diameter of the tube 12 to be pulled through the tube.

Figure 6:
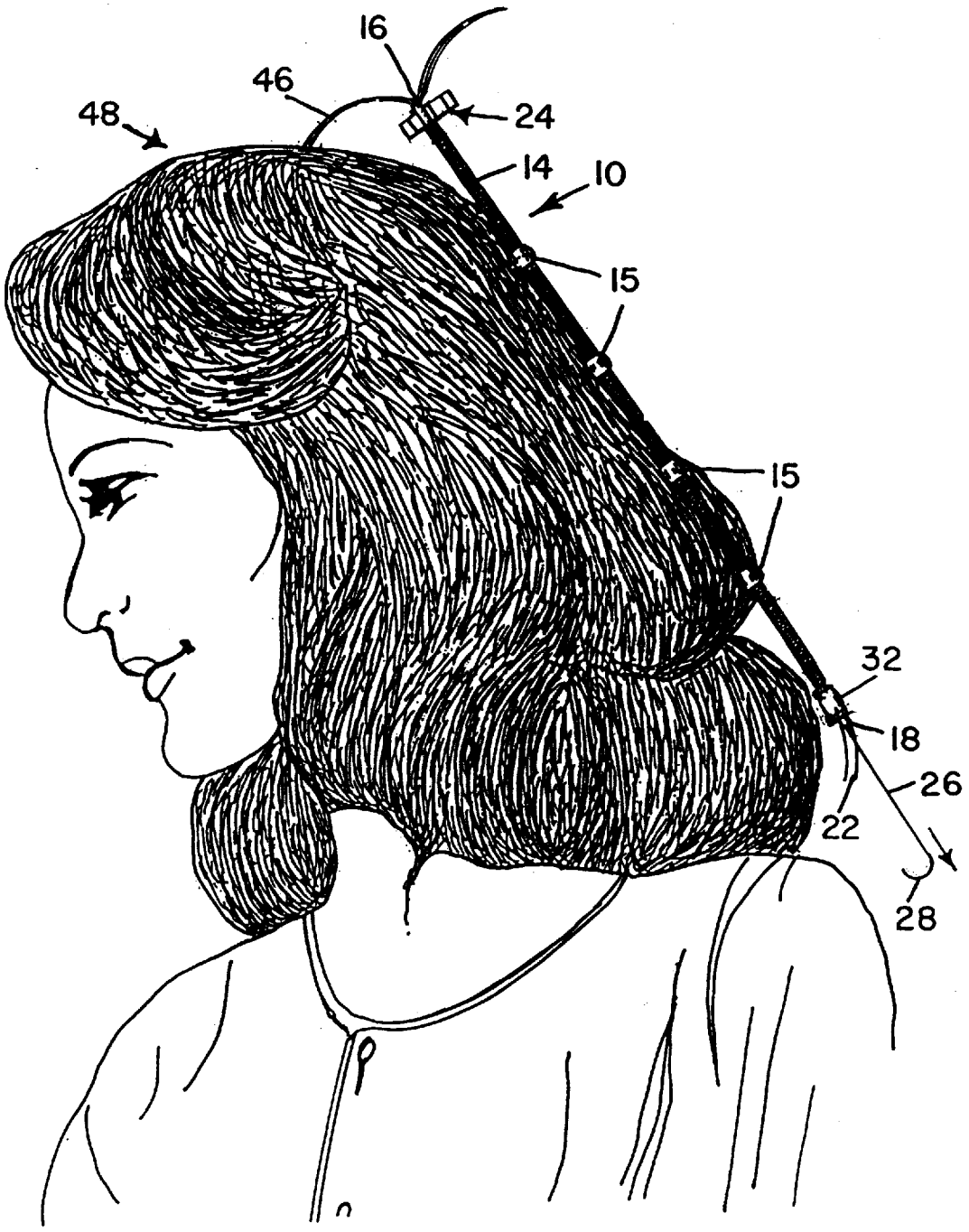
Figure 7:
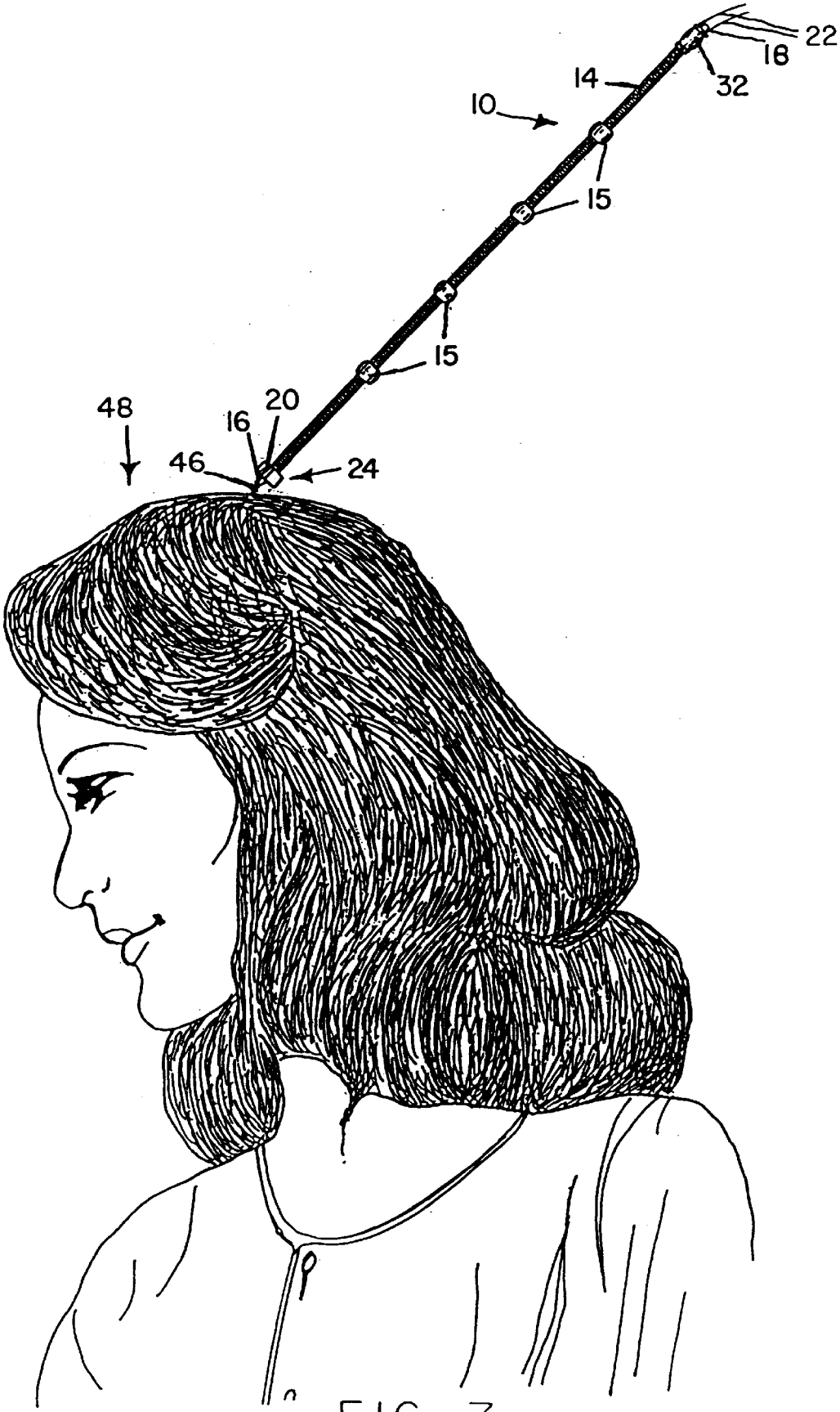
Figure 8:
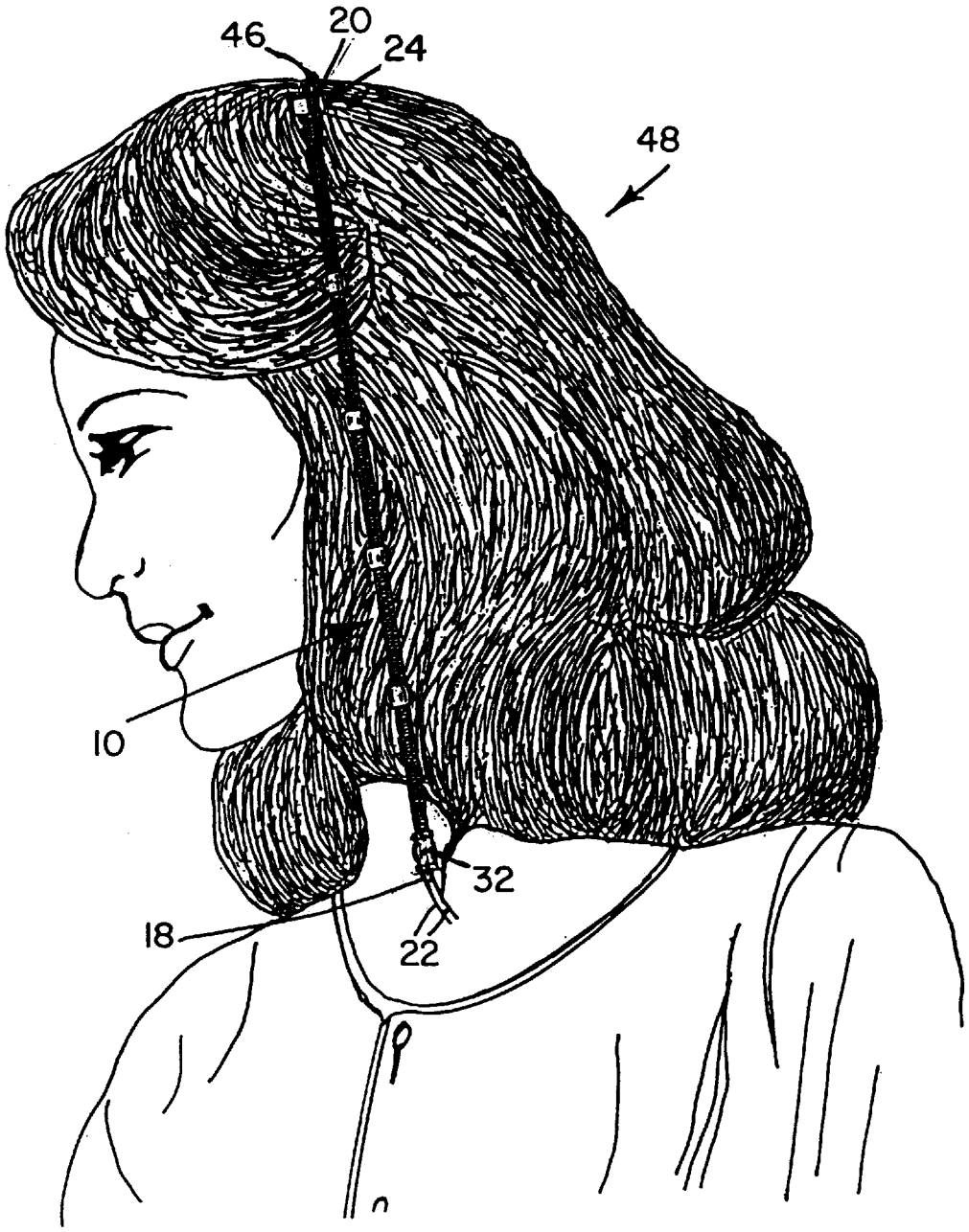

Referring particularly to FIGS. 5–8, the hair decoration device 10 of the present invention is applied to the hair of an individual, indicated by the reference numeral 48, by taking a strand of hair, indicated by the reference numeral 46 in FIG. 5, and passing this strand of hair through the loop 30. Preferably, the strand of hair is twisted and folded into a narrow loop which is inserted through the loop 30. The end 28 of the wire 26 is pulled away from the second open end 18 of the tube 12, as shown in FIG. 6, thereby pulling the loop 30 and the strand of hair 46 into the tube 12 at the first open end 16. After the strand of hair 46 has been pulled entirely into the tube 12, the strand of hair 46 is secured to the hair decoration device 10 by closing the clasp 24 which compresses the tube and clamps the strand of hair 46 within the tube near the scalp, as shown in FIG. 7. The hair decoration device 10 is then released so that it can hang freely along the outside of a persons hair, as shown in FIG. 8, so that it completely simulates a conventional hair wrapping procedure, but in substantially less time. The strands of material 20 which is used to tie the hair decoration device 10 to the strand of hair 46 is tied in as tight a knot as possible and tied around the tube 12 at the first end of the tube near the scalp. The strands 20 are trimmed as close to the knot as possible. Any portion of the strand of hair 46 which extends from the second end of the tube 12 may be trimmed off or left in place as desired. The embodiment shown in FIGS. 1–8 is the preferred embodiment.

Figure 9:
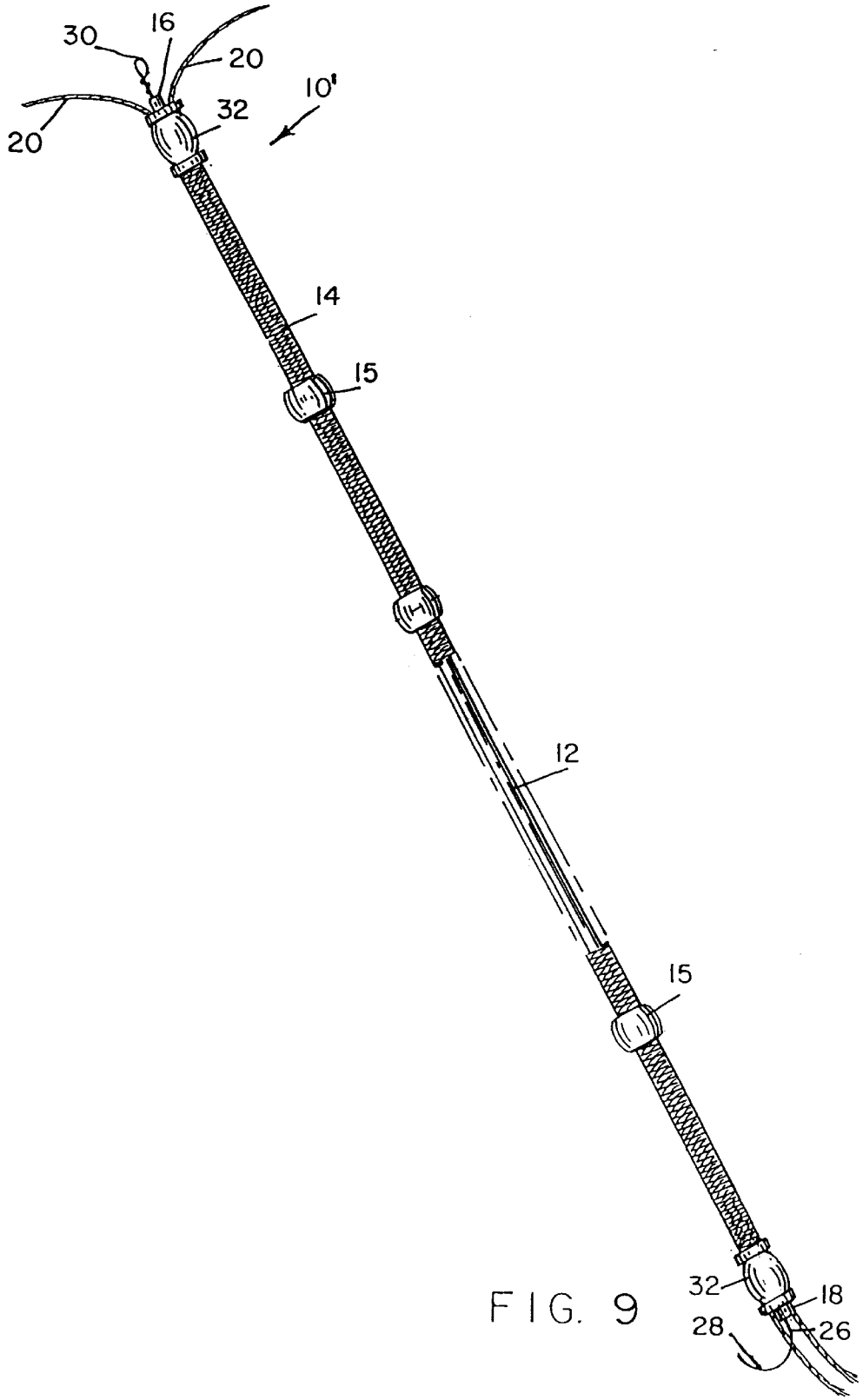
FIG. 9 is a side elevational view of a modified hair decoration device.

Referring to FIG. 9, a modified hair decoration device is generally indicated by the reference numeral 10'. The device 10' is identical to the device 10 except that the free ends 20 of the decorative strands are tied to the first end of the tube 12 and extend beyond the first end of the tube. Also, there is no clasp 24. The free ends 20 extend between a decorative bead 32 and the tube 12. The operation of the device 10' is the same as for the device 10 except that after the strand of hair 46 has been drawn into the tube 12, as shown in FIG. 7, the free ends 20 are tied to a strand of hair to secure the device 10' to the strand of hair.

What is claimed is:

1. A method of forming and applying a hair decoration device to a person's hair, said method comprising the following steps:

(a) winding at least one strand of flexible decorative material around an outer surface of an elongated open ended tube for substantially the entire length of said tube, each of said tube and said strand of decorative flexible material having a first end and a second end;

(b) inserting a first end of an elongated filament into the second end of said tube and extending said filament through said tube so that the first end of said filament extends beyond the first end of said tube and a second end of said filament extends beyond the second end of said tube;

(c) forming a loop at the first end of said filament prior to or after insertion of said filament into said tube;

(d) positioning the first end of said tube adjacent a person's hair;

(e) extending a strand of said person's hair through said loop;

(f) pulling the filament relative to said tube so that the first end of said filament and said strand of hair is drawn into said tube;

(g) securing one of the first end of said tube and said decorative layer to said strand of hair to form a decoration comprising said tube and said strand of flexible decorative material; and (h) removing the filament from said tube.

2. A method of applying a hair decoration device to a person's hair, said hair decoration device having a decorative layer comprising at least one strand of flexible decorative material wound around and surrounding an elongated tube which has a first open end and a second open end, and a filament which extends completely through the tube, said filament having a first end which extends the first end of the tube and decorative layer and a second end which extends beyond the second end of the tube and the decorative layer, the second end of said filament having a loop, said method comprising the following steps:

(a) positioning the first end of the tube adjacent a person's hair;

(b) extending a strand of hair through the loop;

(c) pulling the filament relative to the tube so that the first end of the filament and said strand of hair are drawn into the tube;

(d) securing one of the first end of the tube and the first end of the decorative layer to the strand of hair; and (e) withdrawing the filament from the tube.

3. Hair decoration device comprising:

(a) an elongated tube having a first open end and a second open end, said first end having a first opening, said second end having a second opening;

(b) a decorative layer surrounding said elongated tube, said decorative layer having a first end adjacent the first end of said tube and a second end adjacent the second end of said tube, said decorative layer comprising at least two strands of flexible material wound around said tube;

(c) a filament which is slidably mounted within said tube, said filament having a first end which extends beyond the first end of said tube and has a loop outside of said tube, said filament having a second end which extends beyond the second end of said tube for enabling a strand of hair to be inserted through said loop and for pulling said strand of hair into said tube along with said loop by pulling the second end of said filament away from the second end of said tube; and (d) freely extending ends from said two strands of flexible material at the first end of said decorative layer material for connecting the first end of one of said decorative layer and said tube to a strand of hair which has been pulled into said tube.

4. A method of forming and applying a hair decoration device to a person's hair, said method comprising the following steps:

(a) applying a decorative layer of material to an outer surface of an elongated open ended tube, each of said tube and said decorative layer having a first end and a second end, said layer of decorative material having at least two strands of flexible material at the first end of said decorative material;

(b) inserting a first end of an elongated filament into the second end of said tube and extending said filament through said tube so that the first end of said filament extends beyond the first end of said tube and a second end of said filament extends beyond the second end of said tube;

(c) forming a loop at the first end of said filament prior to or after insertion of said filament into said tube;

(d) positioning the first end of said tube adjacent a person's hair;

(e) extending a strand of said person's hair through said loop;

(f) pulling the filament relative to said tube so that the first end of said filament and said strand of hair is drawn into said tube;

(g) securing one of the first end of said tube and said decorative layer to said strand of hair by tieing said two strands of flexible material to said strand of hair; and (h) removing the filament from said tube.

5. A method of applying a hair decoration device to a person's hair, said hair decoration device having a decorative layer comprising at least two strands of flexible decorative material wound around and surrounding an elongated tube which has a first open end a second open end, a filament which extends completely through the tube, each of said strands of decorative material having a free end which extends beyond the first end of said tube, said filament having a first end which extends the first end of the tube and decorative layer, the second end of said filament having a loop, said method comprising the following steps:

(a) positioning the first end of the tube adjacent a person's hair;

(b) extending a strand of hair through the loop;

(c) pulling the filament relative to the tube so that the first end of the filament and said strand of hair are drawn into the tube;

(d) securing said hair decoration device by tieing the free ends of said strands of decorative material to said strand of hair; and (e) withdrawing the filament from the tube.

6. Hair decoration device comprising:

(a) an elongated tube having a first open end and a second open end, said first end having a first opening, said second end having a second opening;

(b) a decorative layer surrounding said elongated tube, said decorative layer comprising at least two strands of flexible material wound around said tube, said strands having first ends adjacent the first end of said tube and second ends adjacent the second end of said tube;

(c) a filament which is slidably mounted within said tube, said filament having a first end which extends beyond the first end of said tube and has a loop outside of said tube, said filament having a second end which extends beyond the second end of said tube for enabling a strand of hair to be inserted through said loop and for pulling said strand of hair into said tube along with said loop by pulling the second end of said filament away from the second end of said tube; and (d) connecting means for connecting the first end of one of said decorative layer and said tube to a strand of hair which has been pulled into said tube to form a hair decoration comprising said tube and said decorative layer.

7. Hair decoration device as recited in claim 6, further comprising means for securing the first end of said decorative layer to the first end of said tube.

8. Hair decoration device as recited in claim 6, wherein said tube is resiliently compressible and said connecting means is a releasable clasp for compressing said tube and said strands of hair within said tube at said first end of said tube.

9. Hair decoration device as recited in claim 6, further comprising means for securing the second end of said decorative layer to the second end of said tube.

* * * * *